US011359371B2

(12) United States Patent
Burnquist et al.

(10) Patent No.: US 11,359,371 B2
(45) **Date of Patent: *Jun. 14, 2022**

(54) BUILDING BLOCK, WALL CONSTRUCTIONS MADE FROM BUILDING BLOCKS, AND METHODS

(71) Applicant: Anchor Wall Systems, Inc., Minnetonka, MN (US)

(72) Inventors: Robert Brian Burnquist, Chaska, MN (US); Jonathan Michael Schlueter, Medina, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/088,294

(22) Filed: Nov. 3, 2020

(65) Prior Publication Data

US 2021/0108409 A1 Apr. 15, 2021

Related U.S. Application Data

(63) Continuation of application No. 16/440,243, filed on Jun. 13, 2019, now Pat. No. 10,858,828, which is a continuation of application No. 15/464,504, filed on Mar. 21, 2017, now Pat. No. 10,358,817.

(51) Int. Cl.

| | |
|---|---|
| ***E04B 2/36*** | (2006.01) |
| ***E02D 29/02*** | (2006.01) |
| ***E04C 1/39*** | (2006.01) |
| *E04B 2/02* | (2006.01) |

(52) U.S. Cl.

CPC ..... *E04B 2/36* (2013.01); *E02D 29/025* (2013.01); *E02D 29/0266* (2013.01); *E04C 1/39* (2013.01); *E04C 1/395* (2013.01); *E02D 2300/002* (2013.01); *E04B 2002/0245* (2013.01); *E04B 2002/0265* (2013.01)

(58) Field of Classification Search

CPC ..... E02D 29/025; E02D 29/0266; E02D 2200/16; E02D 2300/002; E02D 2600/20; E04B 2/30; E04B 2/36; E04B 2002/0245; E04B 2002/0265; E04C 1/39; E04C 1/395

See application file for complete search history.

(56) References Cited

U.S. PATENT DOCUMENTS

| | | | |
|---|---|---|---|
| 4,295,313 | A | 10/1981 | Rassias |
| 4,319,440 | A | 3/1982 | Rassias et al. |
| 4,485,604 | A | 12/1984 | Rocco et al. |
| 4,802,320 | A | 2/1989 | Forsberg |
| 5,294,216 | A | 3/1994 | Sievert |
| 5,711,130 | A | 1/1998 | Shatley |
| 5,816,749 | A | 10/1998 | Bailey, II |
| 5,848,511 | A | 12/1998 | Scales |

(Continued)

FOREIGN PATENT DOCUMENTS

| | | | |
|---|---|---|---|
| CA | 2504456 | A1 | 10/2006 |

OTHER PUBLICATIONS

International Search Report and Written Opinion for Application No. PCT/US2018/023153 dated Jun. 5, 2018, 17 pages.

*Primary Examiner* — James M Ference

(74) *Attorney, Agent, or Firm* — Merchant & Gould P.C.

(57) ABSTRACT

A concrete building block includes indicators along each end to assist in aligning a pin placed in the block with a channel in a like block in a course below as a wall is being constructed.

4 Claims, 8 Drawing Sheets

(56) References Cited

U.S. PATENT DOCUMENTS

| | | | | |
|---|---|---|---|---|
| 5,913,790 | A | 6/1999 | Dawson | |
| 5,951,210 | A | 9/1999 | Maguire et al. | |
| 5,984,589 | A | 11/1999 | Ciccarello | |
| 6,019,550 | A | 2/2000 | Wrigley et al. | |
| 6,035,599 | A | 3/2000 | Sonnentag | |
| 6,149,352 | A | 11/2000 | MacDonald | |
| 6,178,715 | B1 | 1/2001 | Pacitto et al. | |
| 6,488,448 | B1 | 12/2002 | Blomquist et al. | |
| 6,615,561 | B2 | 9/2003 | MacDonald et al. | |
| 6,701,687 | B1 | 3/2004 | Shillingburg | |
| 7,168,892 | B1 | 1/2007 | MacDonald et al. | |
| 7,244,079 | B1 | 7/2007 | Blomquist et al. | |
| 8,176,702 | B2 * | 5/2012 | Adam | E04C 1/395 52/575 |
| 8,240,105 | B2 | 8/2012 | Dueck | |
| 8,887,469 | B2 | 11/2014 | MacDonald et al. | |
| 9,574,317 | B2 | 2/2017 | MacDonald | |
| 10,358,817 | B2 | 7/2019 | Burnquist et al. | |
| 2001/0004822 | A1 | 6/2001 | Martin et al. | |
| 2002/0001509 | A1 | 1/2002 | Hong | |
| 2002/0083657 | A1 | 7/2002 | Mattox et al. | |
| 2003/0009970 | A1 | 1/2003 | MacDonald et al. | |
| 2003/0012608 | A1 | 1/2003 | Race | |
| 2003/0012609 | A1 | 1/2003 | Woolford | |
| 2003/0074856 | A1 | 4/2003 | Hammer | |
| 2006/0117697 | A1 | 6/2006 | Adam | |
| 2009/0188196 | A1 | 7/2009 | MacDonald | |
| 2010/0284751 | A1 | 11/2010 | Price | |
| 2011/0217127 | A1 | 9/2011 | MacDonald | |
| 2011/0243669 | A1 | 10/2011 | Friederichs et al. | |
| 2015/0354213 | A1 | 12/2015 | Burnquist et al. | |
| 2018/0274229 | A1 * | 9/2018 | Burnquist | E04C 1/395 |

* cited by examiner

BUILDING BLOCK, WALL CONSTRUCTIONS MADE FROM BUILDING BLOCKS, AND METHODS

CROSS REFERENCE TO RELATED APPLICATIONS

The present application is a continuation of U.S. patent application Ser. No. 16/440,243, filed Jun. 13, 2019, which is a continuation of U.S. patent application Ser. No. 15/464,504, filed Mar. 21, 2017, now U.S. Pat. No. 10,358,817, issued Jul. 23, 2019 which applications are incorporated herein by reference in their entireties.

TECHNICAL FIELD

This disclosure relates to concrete building blocks, which can be used for landscaping walls, retaining walls, or free-standing walls. In particular, this disclosure relates to concrete building blocks that use pins to help prevent shifting of the blocks when assembled in a wall.

BACKGROUND

Modular concrete blocks can be used to build walls, including free-standing walls, retaining walls, and landscaping walls. These blocks can be used either by contractors or by individuals in the "do it yourself" market.

The use of pins to interconnect blocks to construct vertical walls or inclined retaining walls is known, in order to help provide a stable and secure wall and to prevent the shifting of blocks relative to each other after assembly into a wall.

One problem with existing pinned blocks is the difficulty encountered by the installer in aligning the blocks of one course on top of a previous course for proper placement of the pins to interconnect the blocks.

SUMMARY

A building block is provided including a body having opposite front and rear faces, opposite first and second bearing faces extending between the front and rear faces, and opposite first and second ends extending between the front and rear faces. The first and second bearing faces each include two pin receiving apertures extending through the body. The first bearing face is an upper face in use and has one or more channels to receive one end of pins extending through the pin receiving apertures of a like block stacked on the first bearing face. The first end includes a first recess having a first recess edge. A first of the pin receiving apertures is located adjacent the first recess edge. A first indicator in the first recess is adjacent the first pin receiving aperture. The first indicator is visible from the first end to assist in aligning a pin placed in the first pin receiving aperture with a channel in a like block in the course below as a wall is being constructed. The second end includes a second recess having a second recess edge. A second of the pin receiving apertures is located adjacent the second recess edge. A second indicator is in the second recess adjacent the second pin receiving aperture, in which the second indicator is visible from the second end to assist in aligning a pin placed in the second pin receiving aperture with a channel in a like block in the course below as a wall is being constructed.

In example embodiments, the rear face is shorter in length than the front face.

In example embodiments, the one or more channels includes a plurality of channels adjacent the first recess edge and the second recess edge.

In some embodiments, the plurality of channels includes a plurality of channels extending from the first recess edge to the second recess edge.

In example embodiments, the plurality of channels includes a plurality of channels extending from the first recess edge partially along the first bearing face, and a plurality of channels extending from the second recess edge partially along the first bearing face.

In some implementations, there are no more than three channels adjacent the first recess edge, and no more than three channels adjacent the second recess edge.

In example embodiments, the first and second bearing faces have planar contact surfaces.

In one or more embodiments, at least a portion of the first pin receiving aperture is open into the first recess through the recess edge, and the first indicator comprises the portion along the first recess edge in which the first pin receiving aperture is open. At least a portion of the second pin receiving aperture is open into the second recess through the recess edge, and the second indicator comprises the portion along the second recess edge in which the second pin receiving aperture is open.

In example embodiments, the first pin receiving aperture is open into the first recess along the entire length of the first pin receiving aperture. The second pin receiving aperture is open into the second recess along the entire length of the second pin receiving aperture. As a pin is inserted through the first and second pin receiving apertures, the pin is visible from the corresponding end of the block and into a channel in a like block in the course below, as a wall is being constructed.

In some example embodiments, the first end includes a first end wall adjacent the front face; a second end wall adjacent the rear face; and wherein the first recess edge extends between the first end wall and second end wall; and the second end includes a first end wall adjacent the front face, a second end wall adjacent the rear face, and wherein the second recess edge extends between the first end wall of the second end and the second end wall of the second end.

In one or more embodiments, the first end wall of the first end extends at an angle toward the second end as the first end wall extends from the front face. The second end wall of the first end extends at an angle away from the second end as the second end wall extends from the rear face.

In many arrangements, the first end wall of the second end extends at an angle toward the first end as the first end wall extends from the front face. The second end wall of the second end extends at an angle away from the first end as the second end wall extends from the rear face.

In many example arrangements, the front face of the block is planar.

In many example arrangements, the rear face of the block is planar.

In one or more embodiments, the first end further includes a first recess wall extending between the first end wall and the first recess edge. A second recessed wall extends between the second end wall and the first recess edge. The first recess edge angles in a direction toward the second end as the first recess edge extends from the first recess wall to the second recess wall.

In one or more embodiments, the second end further includes a first recess wall extending between the first end wall of the second end and the second recess edge. A second recess wall extends between the second end wall of the second end and a second recess edge. The second recess edge angles in a direction toward the first end as the second recess edge extends from the first recess wall of the second end to the second recess wall of the second end.

In some implementations, the first pin receiving aperture is located along the first recess edge 40-60% of the distance between the first recess wall and the second recess wall of the first end. The second pin receiving aperture is located along the second recess edge 40-60% of the distance between the first recess wall and second recess wall of the second end.

In some arrangements, the first recess edge is recessed from the first end wall of the first end a distance of about 5-20% of a length of the front face, and the second recess edge is recessed from the first end wall of the second end a distance of about 5-20% of a length of the front face.

In another aspect, a wall is provided. The wall includes a plurality of courses of the building blocks as variously characterized above. Each course comprises a plurality of the building blocks, and the blocks of each course, after the first course of blocks, is positioned on the blocks of a next lower course in succession. There are pins in most of the pin receiving apertures in the blocks in each course above a base course to engage one of the channels in the first bearing surface of one of the blocks in the next lower course.

In some arrangements, the front face of each block forms a front face of the wall, in use. The wall can be a battered retaining wall, and the pins engage a battered channel in the first bearing surface of one of the blocks in the next lower course to provide a batter to the retaining wall. The battered channel is spaced farther from the front face than the two pin receiving apertures.

In some example arrangements, the front face of each block forms a front face of the wall, in use. The wall can be a vertical wall, and the pins engage a vertical channel in the first bearing surface of one of the blocks in the next lower course to provide a vertical wall. The vertical channel is located the same distance from the front face as the two pin receiving apertures.

In some embodiments, for at least one course, the pins engage a decorative channel in the first bearing surface of one of the blocks in the next lower course, in which the decorative channel is located spaced closer to the front face than the two pin receiving apertures.

In another aspect, a method of constructing a wall using building blocks as variously characterized above is provided. The method includes providing a base course of the building blocks. There is a step of stacking a second course of the building blocks on the bearing surfaces of the base course, with the indicators of the blocks in the second course aligned with channels in the blocks in the base course. After stacking the second course, there is a step of inserting pins into the pin receiving apertures and engaging the pins with one of the channels in the first bearing surface of the blocks in the base course.

A variety of examples of desirable product features or methods are set forth in part in the description that follows, and in part, will be apparent from the description, or may be learned by practicing various aspects of the disclosure. The aspects of the disclosure may relate to individual features, as well as combinations of features. It is to be understood that both the foregoing general description, and the following detailed description, are explanatory only, and are not restrictive of the claimed inventions.

DETAILED DESCRIPTION

Figure 1:
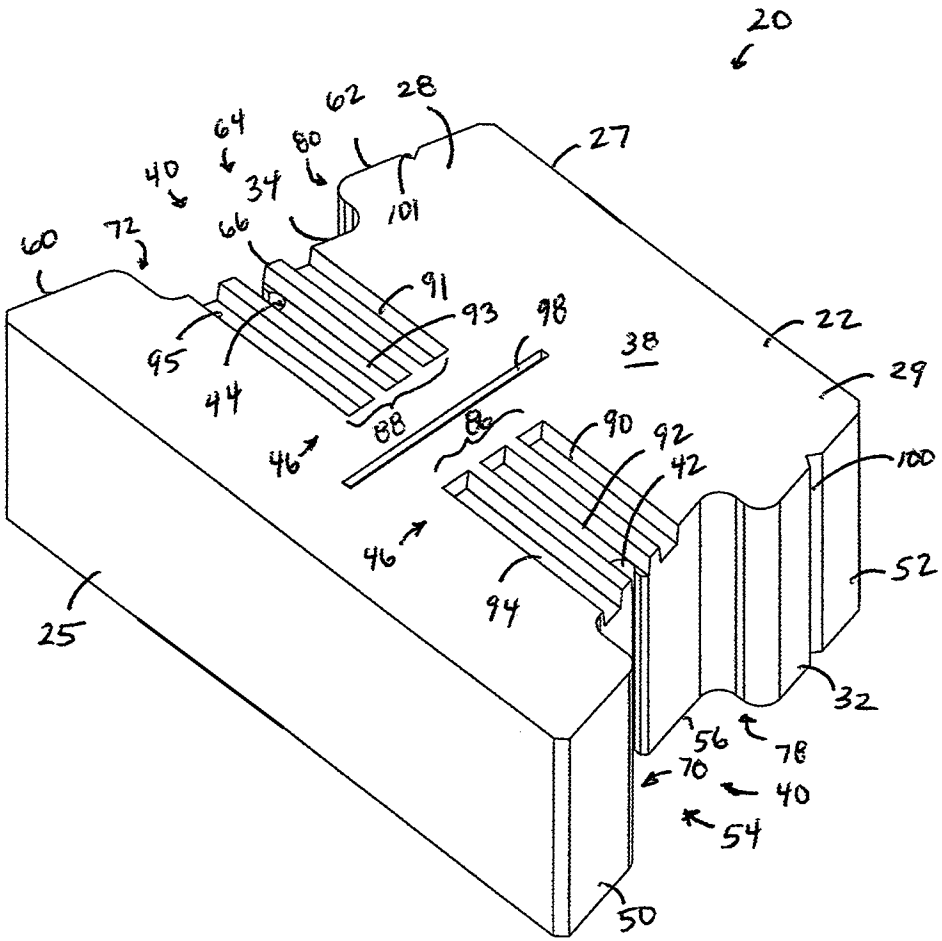
FIG. 1 is a perspective view of a first embodiment of a building block constructed in accordance with the principles of this disclosure.

FIG. 1 is a perspective view of an embodiment of a building block 20 of the present invention. The building block 20 can be used for retaining walls, freestanding walls, landscaping walls, garden walls, and the like. The building block 20 is molded from a concrete material, preferably a dry cast concrete.

The building block 20 includes a body 22. The body 22 has opposite front and rear faces 25, 27.

The body 22 includes opposite first and second bearing faces 28, 30. The first and second bearing faces 28, 30 extend between the front and rear faces 25, 27. The first bearing face 28, in use, is typically an upper face 29, and the second bearing face 30 is typically a bottom face 31 in use.

The body 20 also includes opposite first and second ends 32, 34 extending between the front and rear faces 25, 27. The first and second ends 32, 34, in use, are often side faces and include features to assist in aligning like blocks 20 in a wall, as described further below.

Figure 2:
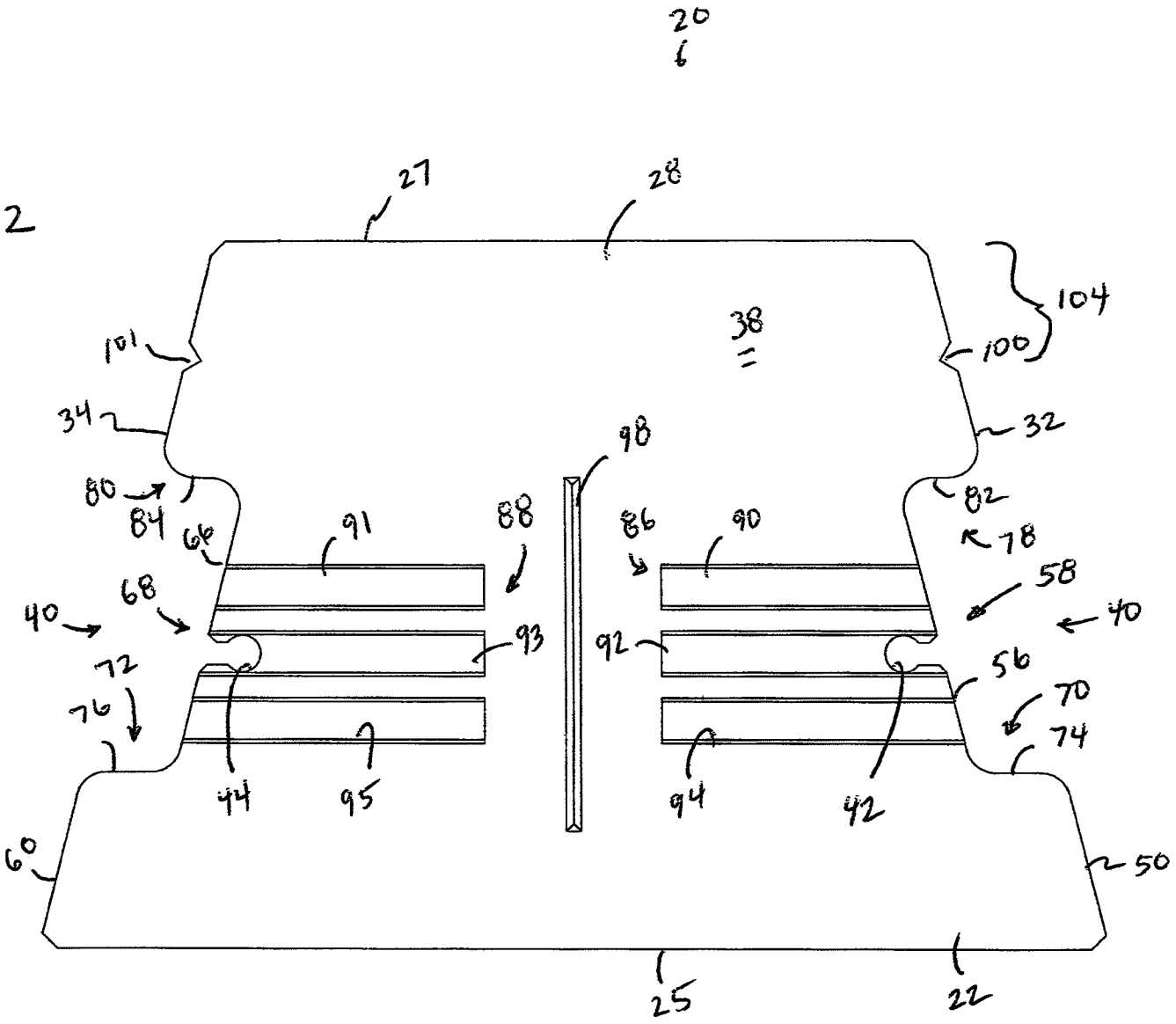
FIG. 2 is a top plan view of the building block of FIG. 1.
Figure 3:
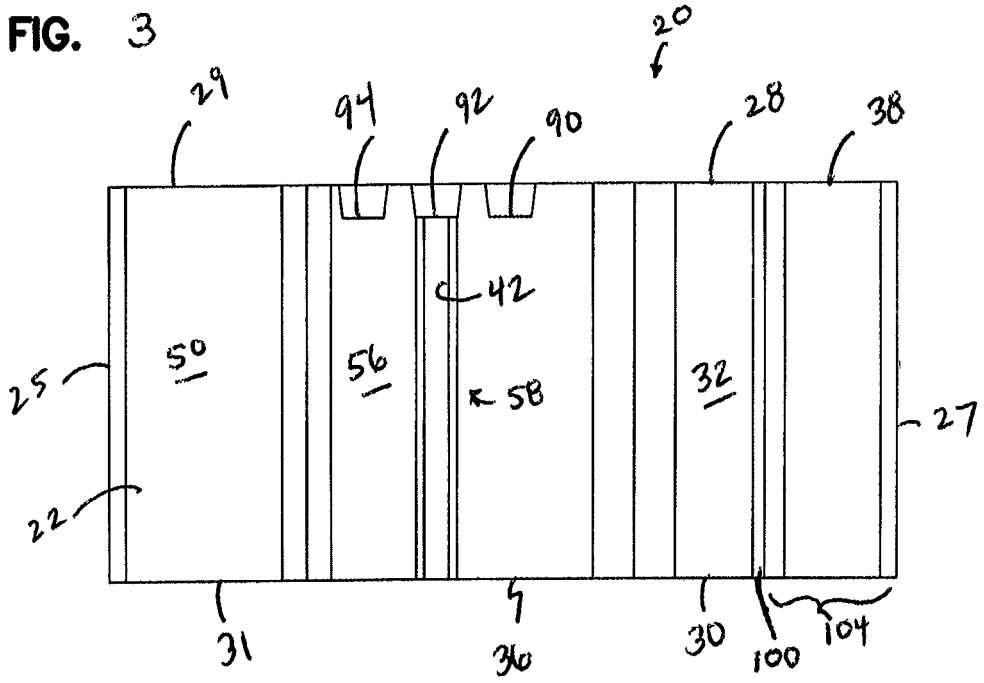
FIG. 3 is a right side view of the building block of FIG. 1.
Figure 4:
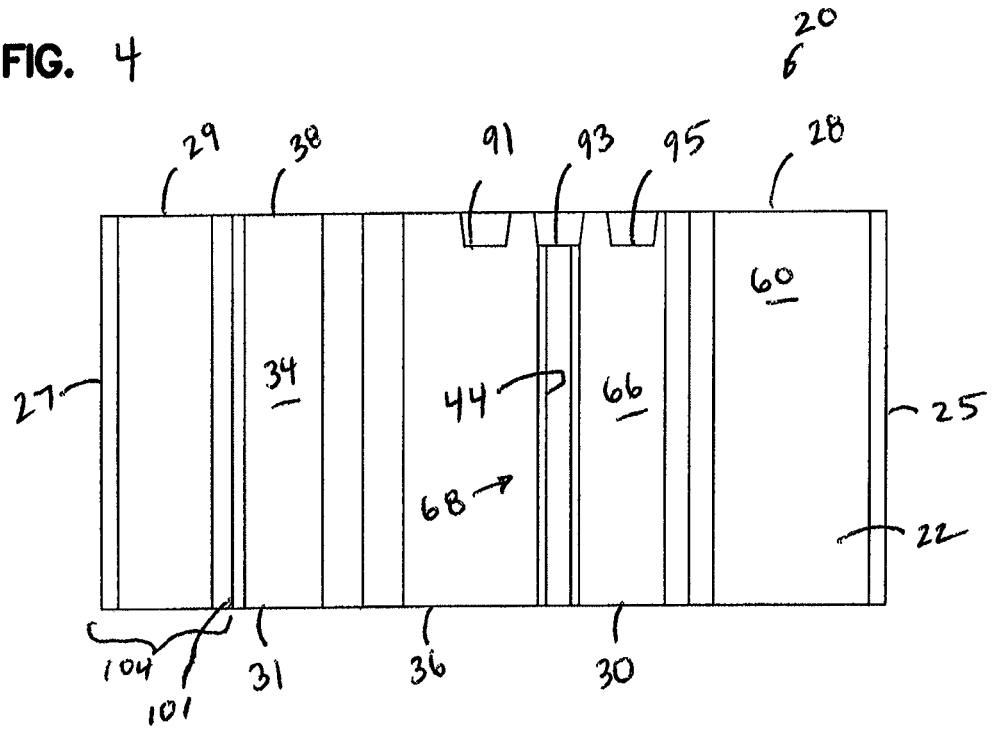
FIG. 4 is a left side view of the block of FIG. 1.

FIG. 2 illustrates a top plan view of the block 20. It can be appreciated, from a review of FIG. 2, that in this embodiment of the block 20, the rear face 27 is shorter in length than the front face 25. In the embodiment shown, the first and second ends 32, 34 angle in a direction toward each other as they extend from the front face 25 to the rear face 27. This feature allows the blocks 20 to form straight or curved walls, including S-shaped curves.

Figure 5:
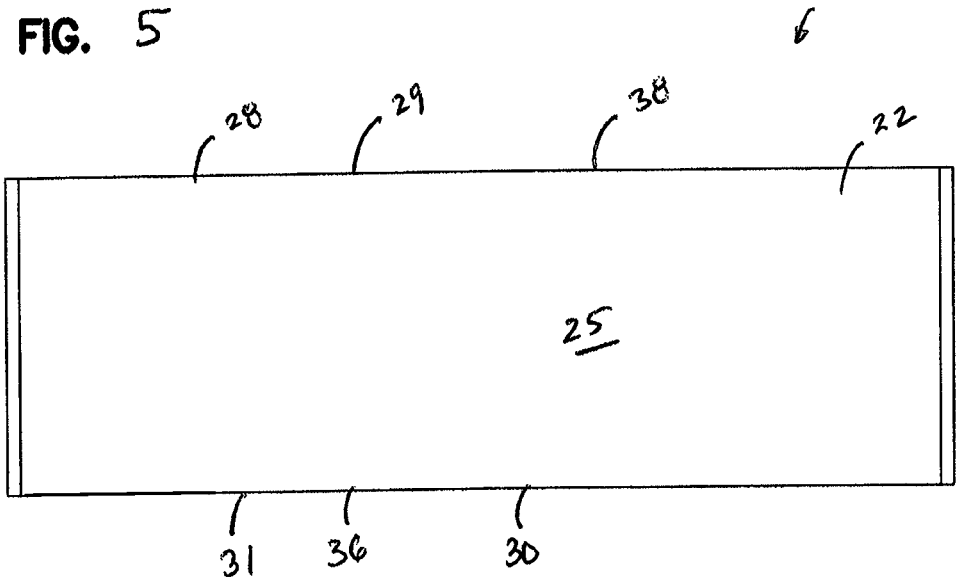
FIG. 5 is a front view of the block of FIG. 1.
Figure 6:
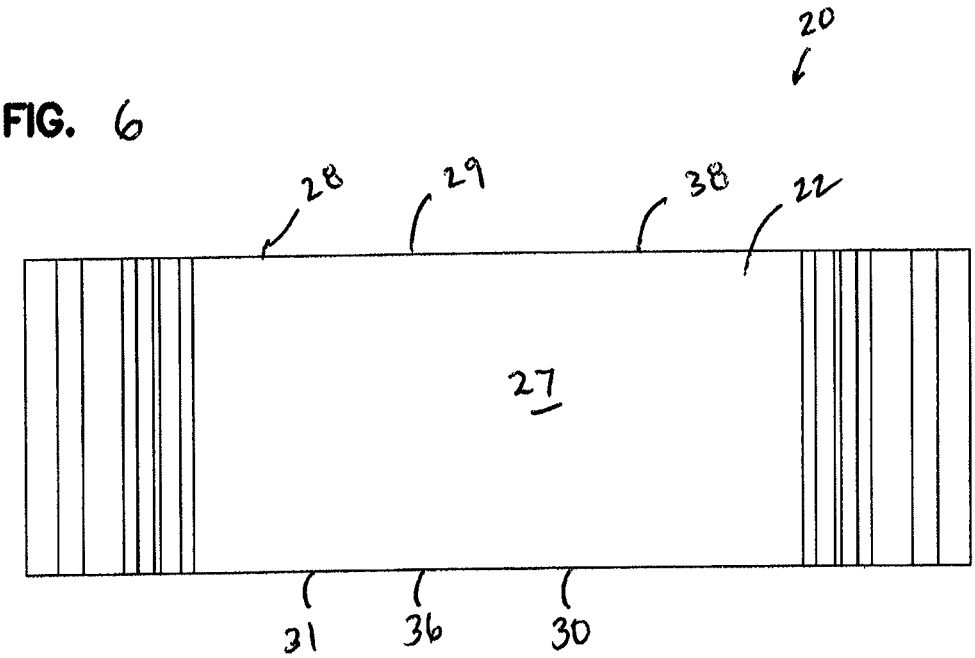
FIG. 6 is a rear view of the block of FIG. 1.

FIG. 5 is a front view of the block 20 of FIG. 1. FIG. 6 is a rear view. As can be appreciated from a review of these FIGS., in this embodiment, the front face 25 (FIG. 5) is generally flat and planar. However, in other embodiments, the front face 25 could be patterned, textured, or a type of split-face.

The rear face 27, shown in FIG. 5, in this embodiment is flat and planar. It could be other shapes in other embodiments.

The first and second bearing faces 28, 30 are constructed for stacking with other like blocks 20. For example, the second bearing face 30, in the embodiment shown, is flat and planar, including no projections or protrusions extending from a contact surface 36 which will rest against the first bearing face 28 of a block 30 upon which it is stacked. The first bearing face 28 also has a planar contact surface 38 which is generally flat, planar, and free of projections or protrusions extending therefrom and it is parallel to the contact surface 36 of the second bearing face 30. The contact surface 38 of the first bearing face 28 will be against the contact surface 36 of a second bearing face 30 of a like block 20 that is resting on top of it. As can be seen in FIGS. 1 and 2, the first bearing face 28 also includes additional features used as part of an alignment system 40. These features generally do not project from the first bearing face 28 and can be planar with or recessed into the first bearing face 28.

As mentioned above, the block 20 includes alignment system 40. The alignment system 40 is used to align the blocks 20 when stacking then to form a wall and to prevent shifting of individual blocks 20 within the wall. The alignment system 40 includes at least a first pin receiving aperture 42 and a second pin receiving aperture 44 extending through the body 22 from the first bearing face 28 through the second bearing face 30.

The first bearing face 28 includes one or more channels 46 that are constructed and arranged to receive one end of pins 48 (FIGS. 7-9) extending through the pin receiving apertures 42, 44 of a like block 20 stacked on the first bearing face 28. The channels 46 can be arranged in various ways to result in certain desirable outcomes. This is described further below. The channels 46 are also part of the alignment system 40.

In reference again to FIGS. 1 and 2, the first and second ends 32, 34 include features used in the alignment system 40. In the embodiments shown, the first end 32 includes a first recess 54 inset or recessed relative to the front and rear faces 25, 27. The first recess 54 includes a first recess edge 56. The first recess 54 can be many different shapes, including inwardly angled or inwardly rounded.

In the example embodiment shown in FIG. 2, the first end 32 includes a first end wall 50 adjacent the front face 25, a second end wall 52 adjacent the rear face 27, with the first recess 54 inset or recessed relative to the first end wall 50 and the second end wall 52. The first recess edge 56 extends between the first end wall 50 and second end wall 52.

The first pin receiving aperture 42 is located adjacent the first recess edge 56. By "adjacent", it is meant that the first pin receiving aperture 52 is immediately adjacent, or within about an inch of, or it is open to the first recess 54 through the edge 56.

As part of the alignment system 40, a first indicator 58 is in the first recess edge 56 adjacent the first pin receiving aperture 42. The first indicator 58 is visible from the first end 32 to assist in aligning a pin 48 placed in the first receiving aperture 42 with a channel 46 in a like block 20 in the course below, as a wall is being constructed. The first indicator 58 can include a variety of visual indicators, including a marking, or, in the embodiment shown, a portion of the first pin receiving aperture 42 is open into the first recess 54 through the first recess edge 56. The first pin receiving aperture 42 is preferably partially open into the first recess 54 along the entire length of the first pin receiving aperture 42. In this way, when a pin 48 is put into the first pin receiving aperture 42, it can be viewed along the open portion from the first end 32 to help align it with the desired channel 46 in the block 20 in the course below.

Similarly, the second end 34 includes a first second recess 64 recessed inwardly in a direction toward the first end 32. The second recess 64 includes a second recess edge 66. The second recess 64 can be many different shapes, including inwardly angled or inwardly rounded.

In the example embodiment of FIG. 2, the second end 34 includes a first end wall 60 adjacent the front face 34, and a second end wall 62 adjacent the rear face 27. The second recess 64 is recessed inwardly in a direction toward the first end 32 from the first end wall 60 and second end wall 62. The second recess edge 66 extends between the first end wall 60 of the second end 34 and the second end wall 62 of the second end 34.

The second pin receiving aperture 44 is located adjacent the second recess edge 66. As defined above, the term "adjacent" means that the second pin receiving aperture 44 is immediately adjacent, or within about an inch of, or it is open to the second recess edge 66.

The second end 34 includes part of the alignment system 40 in the form of a second indicator 68 in the second recess 64 and adjacent the second pin receiving aperture 44. The second indicator 68 is visible from the second end 34 to assist in aligning a pin 48 placed in the second pin receiving aperture 44 with a channel 46 in a like block 20 in the course below as a wall is being constructed.

The second indicator 68 can be embodied in a variety of formats, including visual markings. In the embodiment shown, the second indicator 68 is in the form of a portion of the second pin receiving aperture 44 being open into the second recess 64 through the recess edge 66 to be visible from the second end 34. In preferred embodiments, the second pin receiving aperture 44 is partially open into the second recess 64 along the entire length of the second pin receiving aperture 44. As such, when a pin 48 is inserted through the second pin receiving aperture 44, the pin 48 is visible from the second end 34 and into a desired channel 46 in a like block 20 in the course below, as a wall is being constructed.

The first and second ends 32, 34 may be constructed and shaped in a variety of manners. In the embodiment shown, the block 20 includes a pair of handholds 70, 72, which form part of the first and second ends 32, 34. The handholds 70, 72 are sized for at least a part of a human hand to grasp in order to move and manipulate the block 20.

In this embodiment, a handhold 20 is formed by a first recess wall 74 extending between the first end wall 50 and the first recess edge 56. Similarly, the handhold 72 is formed by a first recess wall 76 extending between a first end wall 60 of the second end 34 and the second recess edge 66. In the embodiment shown, both the first recess wall 74, 76 are generally straight.

Handholds 78, 80 can also be formed at the opposite end of the recess edges 56, 66. In this embodiment, handhold 78 is formed by a second recess wall 82 extending between the second end wall 52 and the first recess edge 56. Handhold 80 can be formed by a second recess wall 84 extending between the second end wall 62 of the second end 34 and the second recess edge 66. The handholds 78, 80 are sized to be grasped by at least a portion of a human hand to move and manipulate the block 20.

In this embodiment, the first recess edge 74 angles in a direction toward the second end 34 as the first recess edge 56 extends from the first recess wall 74 to the second recess wall 82. Similarly, the second recess edge 66 angles in a direction toward the first end 32 as the second recess edge 66 extends from the first recess wall 76 of the second end 34 to the second recess wall 84 of the second end 34.

Still in reference to FIG. 2, it can be appreciated that in embodiments of the blocks 20 that are made for making curved or S-shaped walls, the first end wall 50 of the first end 32 extends at an angle toward the second end 34, as the first end wall 50 extends from the front face 25. The second end wall 52 of the first end 32 extends at an angle away from the second end 34 as the second end wall 52 extends from the rear face 27.

Similarly, the first end wall 60 of the second end 34 extends at an angle toward the first end 32 as the first end wall 60 extends from the front face 25. The second end wall 62 of the second end 34 extends at an angle away from the first end 32, as the second end wall 62 extends from the rear face 27.

The first and second pin receiving apertures 42, 44 can be located along the recess edges 56, 66 in a variety of locations. In some embodiments, the first pin receiving aperture 42 is located along the first recess edge 56 40-60% of the distance between the first recess wall 74 and second recess wall 82 of the first end 32. Similarly, the second pin receiving aperture 44 is located along the second recess edge 66 40-60% of the distance between the first recess wall 78 and second recess wall 84 of the second end 34. Preferably, the first pin receiving aperture 42 and second pin receiving aperture 44 are located at the same distance from their respective first recess walls 74, 78.

The first and second recess edges 56, 66 will be recessed a distance convenient for cooperating with the alignment system 40. In example embodiments, the first recess edge 56 is recessed from the end wall 50 of the first end 32 a distance of about 5-20% of the length of the front face 25. Similarly, the second recess edge 66 is recessed from the first end wall 60 of the second end 34 a distance of about 5-20% of the length of the front face 25.

Attention is again directed to FIGS. 1 and 2. The one or more channels 46 includes a first plurality of channels 86 adjacent the first recess edge 56. A second plurality of channels 88 is adjacent the second recess edge 66 in alignment with the first plurality of channels. While this embodiment shows the first plurality of channels 86 extending from the first recess edge 56 only partially along the first bearing face 28, and the second plurality of channels 88 extending from the second recess edge 66 only partially along the first bearing face 28, it should be understood that in other embodiments, the first plurality of channels 86 and second plurality of channels 88 can meet and form continuous channels extending from the first recess edge 56 to the second recess edge 66.

The channels 46 are formed in the first bearing face 28. The depth of the recess of the channels 46 is at least 0.25 inch, typically about 0.5 inch, and no greater than 2 inches.

In the embodiments shown in FIGS. 1 and 2, there are three channels as part of the first plurality of channels 86 adjacent the first recess edge 56, and three channels as part of the second plurality of channels 88 adjacent the second recess edge 66. In this embodiment, one end of the pin receiving apertures 42, 44 are in the outer ends of the middle channels.

In this embodiment, the channels 46 are generally parallel to each other, and may be generally parallel to the rear face 27 or rear face 27 of the block, when the rear face 27 is flat and planar. When the front face 25 of the block is flat and planar, the channels 46 are also generally parallel to the front face 25.

Figure 7:
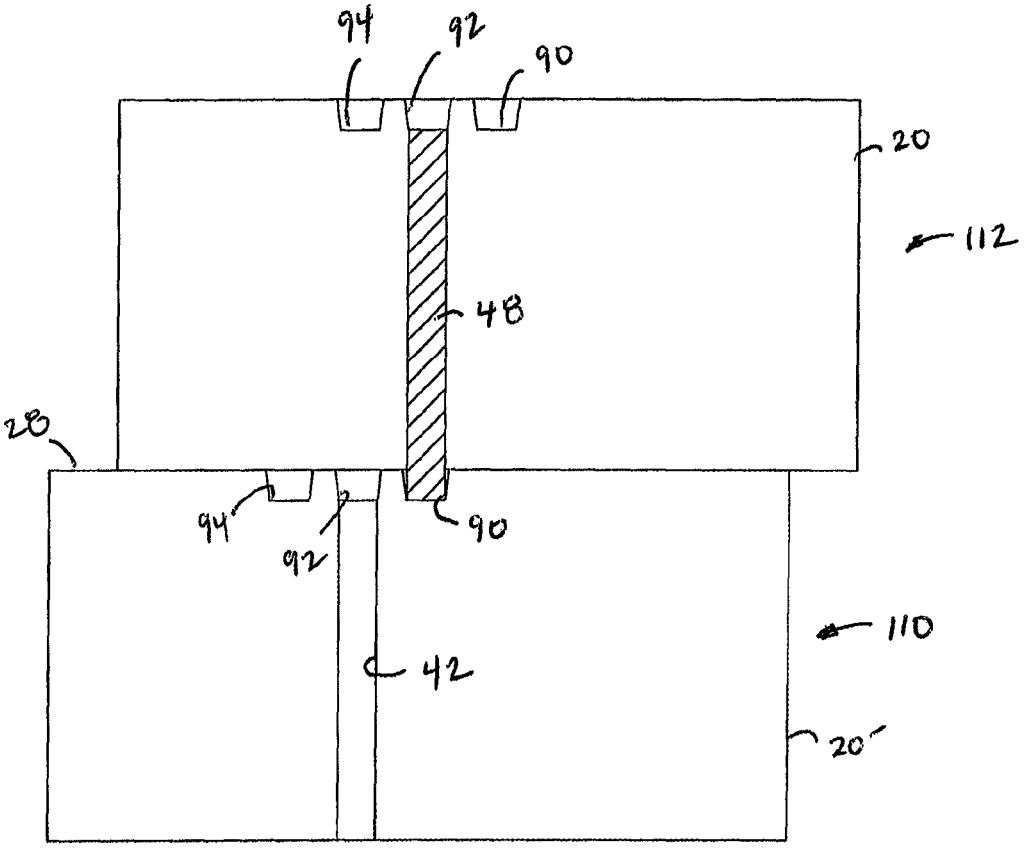
FIG. 7 is a schematic side view of one block of FIGS. 1-6 stacked on another like block using a pin located in a battered channel of the block in the base course.

In this embodiment, the channel 46 that is spaced the farthest from the front face 25 and between the pin receiving apertures 42, 44 and the rear face 27 is a battered channel 90, 91. The battered channel 90, 91 is for receiving pins 48 from a block 20 in a course above in order to create a batter for a retaining wall as illustrated in FIG. 7.

The channels 46 that are located the same distance from the front face 25 as the pin receiving apertures 42, 44 are vertical channels 92, 93. The vertical channels 92, 93 are for receiving pins 98 in blocks 20 in a course above them to create a vertical wall without a batter (i.e. with zero batter) and without protruding blocks.

The channels 46 include a channel that is the closest to the front face 25 and between the front face 25 and the pin receiving apertures 42, 44. These channels 46 are decorative channels 94, 95, which are spaced closer to the front face 25 than the two pin receiving apertures 42, 44. The decorative channels 94, 95 are for aligning a block 20 in the course above to protrude outwardly relative to the course below, in order to create a decorative effect.

In FIGS. 1 and 2, there is also, in this embodiment, a splitting groove 98 extending between the first plurality of channels 86 and the second plurality of channels 88.

The block 20 may also include an optional indent 100 in the first end 32 and indent 101 in the second end 34. The indents 100, 101 are along the second end walls 52, 62 and are spaced from the rear face 27 a predetermined distance. In applications for freestanding walls that do not include pins, the blocks 20 can be modified by splitting off the section 104 of the block 20 between the indents 100, 101.

Figure 10:
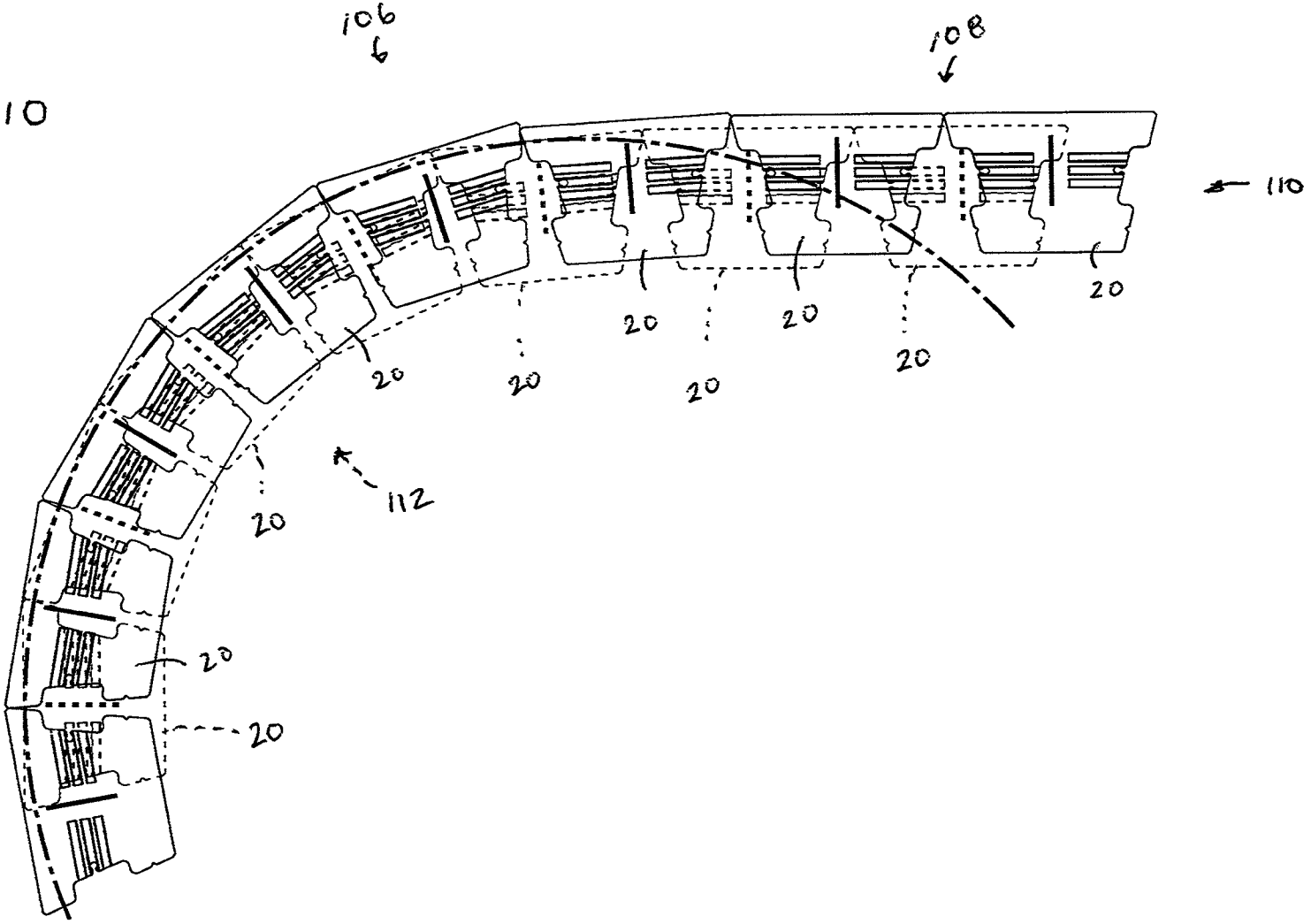
FIG. 10 is a schematic view showing two courses of the blocks of FIGS. 1-6 for forming a retaining wall, with both a straight section and a curved section.

The blocks 20 can be used to construct a wall, such as wall 106 in FIG. 10. The wall 106 includes a plurality of courses 108. In FIG. 10, the base course 110 is shown in solid lines as forming the first or base course. The second course 112 is illustrated in phantom lines stacked on the base course 110 to form a running-bond.

Pins 48 are used in most, and generally all, of the pin receiving apertures 42, 44 in the blocks 20 in each course above the base course 110 to engage one of the channels 46 in the first bearing face 28 of one of the blocks 20 in the next lower course.

In FIG. 7, the pins 48 are shown engaging the battered channels 90 in the first bearing face 28 in the block 20' in the base course 110 to provide a batter.

Figure 8:
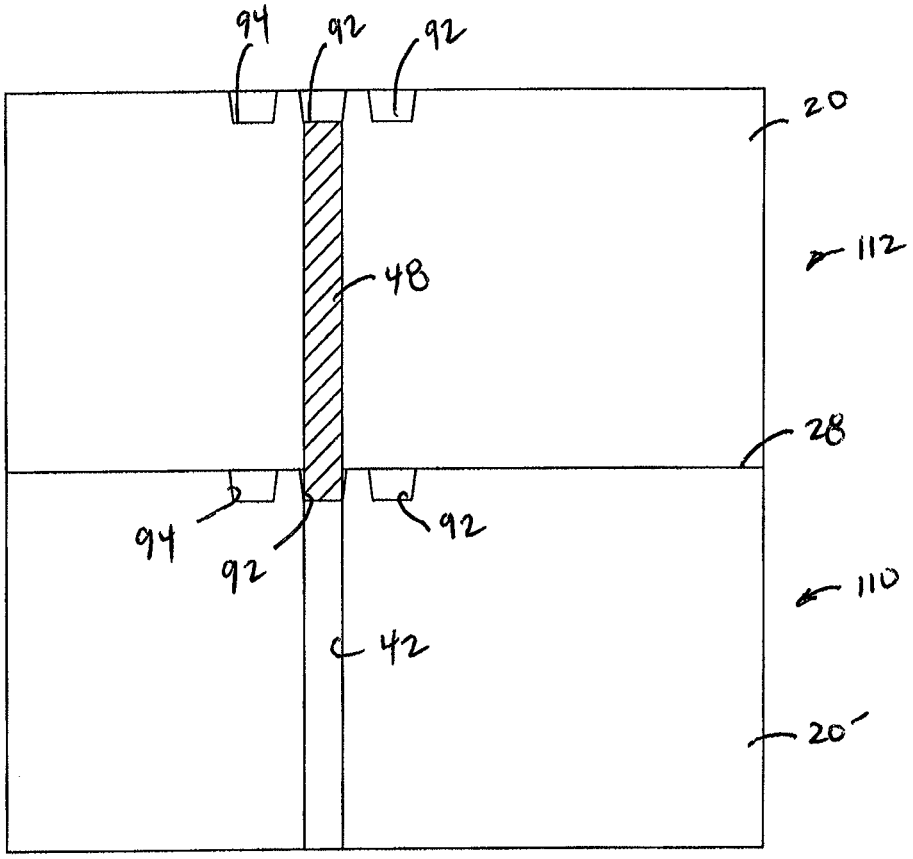
FIG. 8 is another schematic view showing one block of FIGS. 1-6 stacked on another like block using a pin located in a vertical channel in the block in the base course.

In FIG. 8, the pins 48 engage the vertical channels 92 in the first bearing face 28 of the block 20' in the base course 110 to provide a straight vertical wall.

Figure 9:
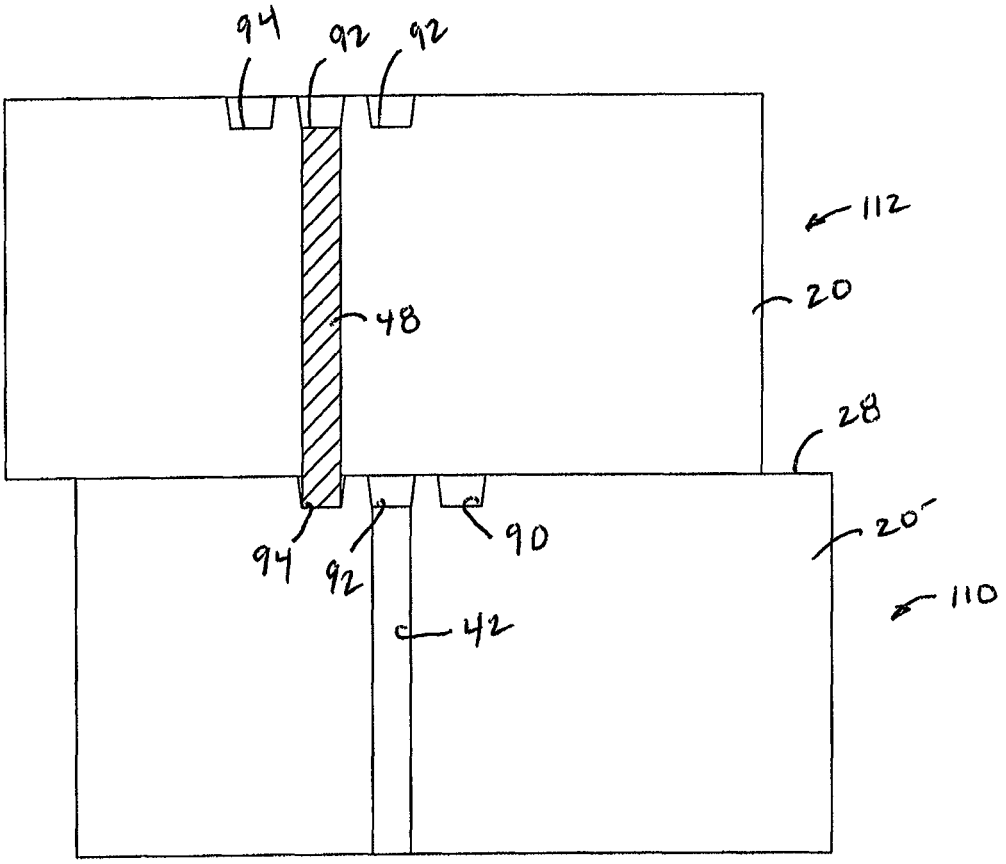
FIG. 9 is a schematic view showing one block of FIGS. 1-6 stacked on another like block, and depicting a pin from the upper block located in the decorative channel in the block in the base course.

In FIG. 9, the pins 48 engage decorative channels 94 in the first bearing face 28 of the blocks 20' in the base course 110.

The blocks 20 can be used in methods of constructing walls. The methods can include providing the base course 110 using building blocks 20. Next, there is a step of stacking a second course 112 of the building blocks 20 on the first bearing faces 28 of the base course 110 with the indicators 58, 68 in the second course 112 aligned with channels 46 in the blocks 20 in the base course 110. After stacking the second course 112, there can be a step of inserting pins 48 into the pin receiving apertures 42, 44 and engaging the pins with one of the channels 46 in the first bearing face 28 of the blocks 20 in the base course 110. These steps can be repeated with subsequent courses stacked on the second course 112, etc.

The blocks 20 can be made in a variety of sizes. Typical dimensions include: the front face 25 having a width of at least 12 inches, no greater than 30 inches, and typically about 16-24 inches, including about 18 inches. The rear face 27 has a width of at least 9 inches, not greater than 18 inches, and typically about 10-14 inches, including about 12 inches. The distance between the front face 25 and rear face 27 can be at least about 8 inches, no greater than 24 inches, and typically 10-14 inches, including about 12 inches. The first end walls 50, 60 can have a length of about 2-4 inches, typically about 3 inches. The second end walls 52, 62 can have a length of about 3-5 inches, typically about 4 inches. The recess walls 56, 66 can have a length of at least about 2 inches, no greater than 10 inches, typically about 4-6 inches, including about 5 inches. The depth of each of the recesses 54, 64 can be about 0.5-3 inches, typically about 1-2 inches, including about 1.5. inches.

The above represents example principles. Many examples can be made using these principles.

What is claimed is:

1. A plurality of building blocks especially adapted to be assembled with a plurality of alignment pins into a multi-course wall comprising a plurality of running-bond courses of said blocks, each of said blocks comprising:

(a) a body having opposite and vertically-oriented front and rear faces, opposite and horizontally-oriented upper and lower faces, and opposite and vertically-oriented right and left end faces;

(b) a right end of the block body comprising a first forward portion extending rearwardly from the front face of the block body and extending from the upper face of the block body to the lower face of the block body, a first recess wall facing rearwardly and extending inwardly from the first forward portion of the right end of the block body and from the upper face to the lower face of the block body, and a first recessed edge wall extending rearwardly from the first recess wall and extending from the upper face to the lower face of the block body, where the first forward portion of the right end of the block body and the first recess wall of the right end of the block body are configured and sized to be securely graspable by a first human hand during assembly of the multi-course wall;

(c) a left end of the block body comprising a second forward portion extending rearwardly from the front face of the block body and extending from the upper face of the block body to the lower face of the block body, a second recess wall facing rearwardly and extending inwardly from the second forward portion of the left end of the block body and from the upper face to the lower face of the block body, and a second recessed edge wall extending rearwardly from the second recess wall and extending from the upper face to the lower face of the block body, where the first forward portion of the left end of the block body and the second recess wall of the left end of the block body are configured and sized to be securely graspable by a second human hand during assembly of the multi-course wall;

(d) a vertically-oriented first pin-receiving aperture extending through the body and having an upper end that opens to the upper face of the block body and a lower end that opens to the lower face of the block body, said first pin-receiving aperture being located adjacent to the first recessed edge wall of the right end and being partially open along a length of the first pin-receiving aperture to the first recessed edge wall of the right end of the block body so that the first pin-receiving aperture is visible from the right end of the block body in assembly of the wall, and a first alignment pin inserted into the first pin-receiving aperture is also visible from the right end of the block body during assembly of the multi-course wall;

(e) a vertically-oriented second pin-receiving aperture extending through the body and having an upper end that opens to the upper face of the block body and a lower end that opens to the lower face of the block body, said second pin-receiving aperture being located adjacent to the second recessed edge wall of the left end and being partially open along a length of the second pin-receiving aperture to the second recessed edge wall of the left end of the block body so that the second pin-receiving aperture is visible from the left end of the block body in assembly of the wall, and a second alignment pin inserted into the second pin-receiving aperture is also visible from the left end of the block body during assembly of the multi-course wall;

(f) a first alignment channel portion formed in the upper face of the block body adjacent to an intersection of the upper face and the second recess edge wall of the left end of the block body, and configured and of such extent so as to receive a lower end of a first alignment pin inserted into a first pin-receiving aperture of a like block placed on said upper face in a running-bond arrangement and to facilitate interconnection of the upper and lower blocks in a first predetermined batter relationship; and (g) a second alignment channel portion formed in the upper face of the block body adjacent to the intersection of the upper face and the first recess edge wall of the right end of the block body, and configured and of such extent so as to receive a lower end of a second alignment pin inserted into a second pin-receiving aperture of a like block placed on said upper face in a running-bond arrangement and to facilitate interconnection of the upper and lower blocks in the first predetermined batter relationship.

2. The plurality of building blocks of claim 1 wherein the first predetermined batter relationship is zero batter.

3. The plurality of building blocks of claim 2 further comprising:

(a) a third alignment channel portion formed in the upper face of the block body adjacent an intersection of the upper face and the second recess edge wall of the left end of the block body and configured and of such extent so as to receive a lower end of a first alignment pin inserted into the first pin-receiving aperture of a like block placed on said upper face in a running-bond arrangement and to facilitate interconnection of the upper and lower blocks in a second predetermined batter relationship;

(b) a fourth alignment channel portion formed in the upper face of the block body adjacent an intersection of the upper face and the first recess edge wall of the right end of the block body and configured and of such extent so as to receive a lower end of a second alignment pin inserted into the second pin-receiving aperture of a like block placed on said upper face in a running-bond arrangement and to facilitate interconnection of the upper and lower blocks in a second predetermined batter relationship; and wherein the second predetermined batter relationship is a constant, non-zero batter.

4. The plurality of building blocks of claim 1 wherein the first predetermined batter relationship is a constant, non-zero batter.

* * * * *